US007944135B2

(12) United States Patent
Walker, Jr.

(10) Patent No.: US 7,944,135 B2
(45) Date of Patent: May 17, 2011

(54) SPARK PLUG AND METHODS OF CONSTRUCTION THEREOF

(75) Inventor: William J. Walker, Jr., Toledo, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 361 days.

(21) Appl. No.: 12/201,703

(22) Filed: Aug. 29, 2008

(65) Prior Publication Data

US 2010/0052500 A1 Mar. 4, 2010

(51) Int. Cl.

| | |
|---|---|
| ***H01T 21/00*** | (2006.01) |
| ***H01T 13/39*** | (2006.01) |
| ***H01T 21/02*** | (2006.01) |
| *F02P 1/00* | (2006.01) |

(52) U.S. Cl. ..... 313/145; 313/118; 313/143; 123/169 R; 123/169 EL; 445/7

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 2,478,656 | A | 8/1949 | Dutterer | |
| 2,875,365 | A | 2/1959 | Pierce | |
| 3,053,214 | A | 9/1962 | Pierce | |
| 4,490,122 | A | 12/1984 | Tromeur | |
| 4,568,855 | A | 2/1986 | Nemeth et al. | |
| 6,191,525 | B1 * | 2/2001 | Tanaka et al. | 313/141 |
| 6,858,975 | B1 | 2/2005 | Matsutani | |
| 6,992,426 | B2 | 1/2006 | Francesconi | |
| 2003/0127959 | A1 | 7/2003 | Nishikawa et al. | |
| 2006/0099872 | A1 * | 5/2006 | McMurray et al. | 445/7 |
| 2008/0018216 | A1 * | 1/2008 | Camilli | 313/141 |

FOREIGN PATENT DOCUMENTS

| | | |
|---|---|---|
| JP | 07-022158 A | 1/1995 |
| JP | 2007-073224 | 3/1995 |

* cited by examiner

*Primary Examiner* — Anne M Hines
*Assistant Examiner* — Tracie Green
(74) *Attorney, Agent, or Firm* — Robert L. Stearns; Dickinson Wright, PLLC

(57) ABSTRACT

A spark plug and method of construction is provided, wherein the spark plug has a generally annular ceramic insulator and a metal shell surrounding at least a portion of the insulator. A ground electrode is operatively attached to the shell, wherein the ground electrode has a ground electrode sparking surface. The spark plug further includes a center electrode having an elongate body with a center electrode sparking surface. The sparking surface of the center electrode and the ground electrode sparking surface provide a spark gap. A brazed joint bonds at least one of the insulator to the shell or the center electrode to the insulator.

26 Claims, 7 Drawing Sheets

SPARK PLUG AND METHODS OF CONSTRUCTION THEREOF

BACKGROUND OF THE INVENTION

1. Field of the Invention

The invention relates generally to spark ignition devices for internal combustion engines and to their method of construction, and more particularly to spark plugs having an outer metal shell and a ceramic insulator received at least partially in the metal shell.

2. Related Art

A spark plug is a spark ignition device that extends into the combustion chamber of an internal combustion engine and produces a spark to ignite a mixture of air and fuel. As illustrated in FIG. 1, a conventional spark plug 1 typically has an outer metal shell 2, a ceramic insulator 3, which is at least partially received and captured in the shell 2, a metallic center electrode 4 extending partially through the insulator 3 to a firing tip 5, and a ground electrode 6 extending from the shell 2 to provide a spark gap 7 in conjunction with the firing tip 5 of the center electrode 4.

Some known problems exists with conventional spark plugs that diminish their useful life. One problem is generally referred to as "thermal breakdown." Thermal breakdown occurs via a mechanism involving a dielectric breakdown of the ceramic material used to construct the insulator 3. Failure from dielectric breakdown occurs in the form of a physical puncture by an electrical arc through the ceramic insulator in response to a high electrical field. the thermal breakdown mechanism occurs when localized heating from a small leakage current lowers the electrical resistivity of the ceramic, causing additional leakage current and additional heating until thermal runaway results in a physical puncture of the insulator. One method to reduce the effects of thermal breakdown is to conduct heat away from the ceramic and prevent thermal runaway. In conventional spark plugs, heat is transmitted from an upper or proximate tip 8 of the electrode 4 that is in electrical communication with a terminal stud 9, through the metallic electrode 4 and through the ceramic material of the insulator 3 to the surrounding metal shell 2, which is in contact with an engine block. A main location for the transmission of the heat through the ceramic insulator 3 to the shell 2 is an interface between the insulator and the shell, commonly at a gasket 10, which is typically compressed between a small shoulder 11 of the insulator 3 and a mating shoulder 12 of the shell 2. The gasket 10 provides a relatively small contact patch, and thus, the heat from the electrical discharge proximate the gasket 10 can not be efficiently dissipated via conduction. Accordingly, thermal conduction between the insulator 3 and the shell 2 of the conventional spark plug 1 is generally insufficient to reduce the thermal dielectric breakdown of the ceramic insulator 3 in this region.

Another problem known to reduce the useful life of conventional spark plugs results from mechanical stresses placed on the ceramic insulator 3, which can result in mechanical failure of the spark plug, such as through premature fatigue cracks in the ceramic material of the insulator 3, which can in turn exacerbate the aforementioned thermal breakdown phenomenon. The mechanical stresses are directly associated with the manner in which the insulator 3 is assembled in the outer metal shell 2. Typically, the insulator 3 is compressed axially between the small lower shoulder 12 in the shell 2, with the intermediary gasket 10 being between the lower shoulder 12 and the small shoulder 11 of the insulator 3, and an upper folded, rolled, or otherwise turned shoulder 13 of the shell 2. This method of assembly, although useful, imparts an axially compressive force on the insulator 3, which in turn can result in stress fractures in the insulator, and ultimately failure of the spark plug 1.

Accordingly, there is a need for spark plugs that resist failure mechanisms due to thermal and mechanical affects, that are suited for use in current and future high temperature/high performance spark ignition devices, that are economical in manufacture and exhibit a long and useful life.

SUMMARY OF THE INVENTION

A spark plug has a generally annular ceramic insulator and a metal shell surrounding at least a portion of the insulator. A ground electrode is operatively attached to the shell, wherein the ground electrode has a ground electrode sparking surface. The spark plug further includes a center electrode having an elongate body with a center electrode sparking surface. The sparking surface of the center electrode and the ground electrode sparking surface provide a spark gap. Further, a brazed joint bonds at least one of the insulator to the shell or the center electrode to the insulator.

In accordance with another aspect of the invention, a method of constructing a spark plug, wherein the spark plug has a generally annular ceramic insulator with a through passage; an outer metal shell having a cavity with an inner surface surrounding at least a portion of the ceramic insulator and having a ground electrode operatively attached thereto, and a center electrode extending into the through passage of the ceramic insulator is provided. The method includes brazing a joint bonding at least one of the insulator to the shell or the center electrode to the insulator.

In accordance with yet another aspect of the invention, the method of constructing a spark plug includes extruding the ceramic insulator.

BRIEF DESCRIPTION OF THE DRAWINGS

These and other aspects, features and advantages of a spark plug constructed in accordance with the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
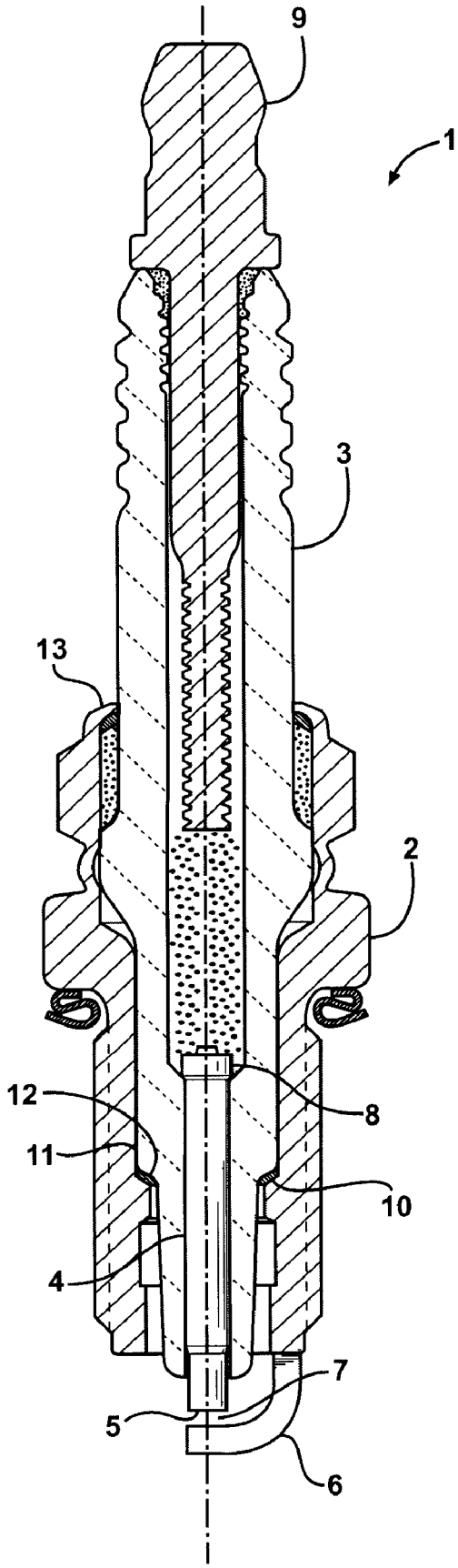
FIG - 1 Prior Art
FIG. 1 is a cross-sectional view of a spark plug constructed in accordance with the prior art.
Figure 2:
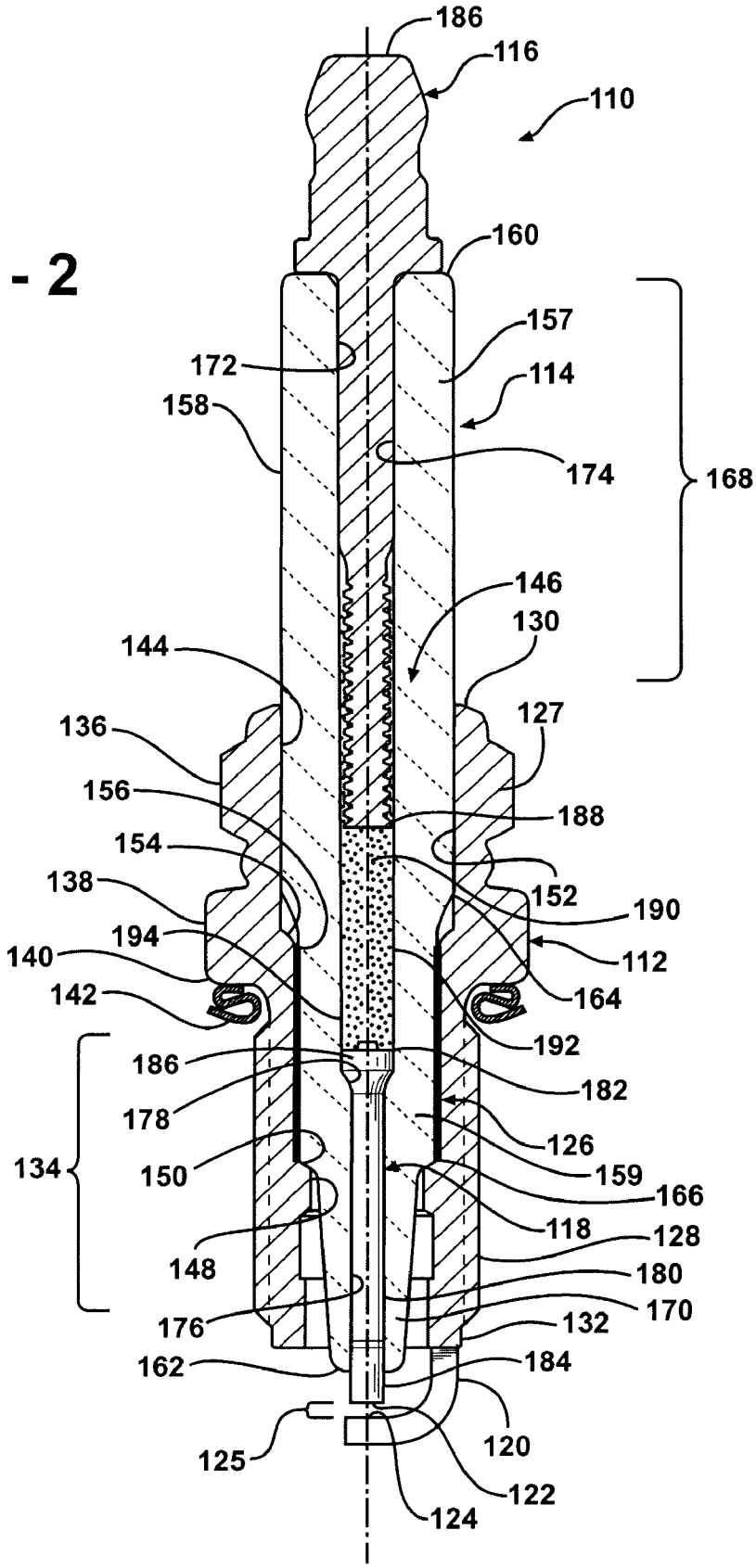
FIG. 2 is a cross-sectional view of a spark plug constructed in accordance with one presently preferred aspect of the invention.

Referring in more detail to the drawings, FIG. 2 illustrates a spark ignition device constructed in accordance with one presently preferred aspect of the invention, referred to hereafter as spark plug 110, used for igniting a fuel/air mixture within an internal combustion engine (not shown). The spark plug 110 includes a metal casing, also referred to as a housing or shell 112, a non-conductive, dielectric ceramic insulator 114 secured within the shell 112, a terminal stud 116 and a center electrode 118 secured within the insulator 114 and a ground electrode 120 operably attached to and extending from the shell 112. The center and ground electrodes 118, 120 have respective firing tips or sparking surfaces 122, 124 located opposite each other to provide a spark gap 125. In accordance with one aspect of the invention, a brazed joint, represented in the embodiment of FIG. 2 at 126, bonds the insulator 114 to the shell 112 and/or the center electrode 118 to the insulator 114.

The electrically conductive metal shell 112 may be made from any suitable metal, including various coated and uncoated steel alloys. The shell 112 has a generally tubular body 127 with a generally annular outer surface 128 extending between an upper terminal end 130 and a lower fastening end 132. The fastening end 132 typically has an external threaded region 134 configured for threaded attachment within a combustion chamber opening of an engine block (not shown). The shell 112 may be provided with an external hexagonal tool receiving member 136 or other feature for removal and installation of the spark plug 110 in the combustion chamber opening. The feature size will preferably conform with an industry standard tool size of this type for the related application. Of course, some applications may call for a tool receiving interface other than a hexagon, such as slots to receive a spanner wrench, or other features such as are known in racing spark plug and other applications. The shell 112 also has an annular flange 138 extending radially outwardly from the outer surface 128 to provide an annular, generally planar sealing seat 140 from which the threaded region 134 depends. The sealing seat 140 may be paired with a gasket 142 to facilitate a hot gas seal of the space between the outer surface of the shell 112 and the threaded bore in the combustion chamber opening. Alternately, the sealing seat 140 may be configured as a tapered seat located along the lower portion of the shell 112 to provide a close tolerance and a self-sealing installation in a cylinder head which is also designed with a mating taper for this style of spark plug seat.

The ground electrode 120 is attached to the fastening end 132, as is known, and is depicted in a commonly used single L-shaped style, it will be appreciated that multiple ground electrodes of straight, bent, annular, trochoidal and other configurations can be substituted depending upon the intended application for the spark plug 110, including two, three and four ground electrode configurations, and those where the electrodes are joined together by annular rings and other structures used to achieve particular sparking surface configurations. The ground electrode 120 sparking surface 124 may have any suitable cross-sectional shape, including flat, arcuate, tapered, pointed, faceted, round, rectangular, square and other shapes, and the shapes of these sparking surfaces may be different.

The tubular shell body 127 has an inner wall or surface 144 providing an open cavity 146 extending through the length of the shell between the terminal and fastening ends 130, 132. An internal lower flange 148 extends radially inwardly from the inner surface 144 adjacent the fastening end 132 to provide a stop surface 150 for the insulator 114. The inner surface 144 is represented in the embodiment of FIG. 2 as having an enlarged diameter region 152 adjacent the terminal end 130 to accommodate the insulator 114. Accordingly, an annular shoulder 154 extends radially inwardly from the enlarged diameter region 152 to a reduced diameter region 156 of the cavity 146. The enlarged diameter region 152 extends upwardly from the shoulder 154 and has a substantially straight, cylindrical and constant diameter to the terminal end 130. Gaskets, cement, or other packing or sealing compounds can also be interposed between the insulator 114 and the shell 130 to perfect a gas-tight seal and to improve the structural integrity of assembled spark plug 110.

The insulator 114, which may include aluminum oxide or another suitable electrically insulating material having a specified dielectric strength, high mechanical strength, high thermal conductivity, and excellent resistance to thermal shock, may be press molded from a ceramic powder in a green state and then sintered at a high temperature sufficient to densify and sinter the ceramic powder. The insulator 114 has an elongate body 157 with an annular outer surface 158 extending between an upper terminal or proximal end 160 and a lower nose or distal end 162. The body 157 may include a lower portion 159 having a large diameter annular upper shoulder 164 and a smaller diameter annular lower shoulder 166. An upper mast portion 168 extends upwardly from the upper shoulder 164 to which a rubber or other insulating spark plug boot (not shown) surrounds and grips to electrically isolate an electrical connection with an ignition wire and system (not shown). The mast portion 168 may include a series of ribs (not shown) or other surface glazing or features to provide added protection against spark or secondary voltage flash-over and to improve the gripping action of the mast portion 168 with the spark plug boot. A reduced diameter nose portion 170 depends from the lower shoulder 166 to the distal end 162. The nose portion 170 typically has a slight taper converging toward the distal end 162, although other configurations, including a straight cylindrical shape are contemplated herein.

The insulator 114 is of generally tubular or annular construction, including a central through passage, also referred to as channel 172, extending longitudinally between the upper proximal end 160 and the lower distal end 162. The channel 172 is represented here as having a varying cross-sectional area, with an increased diameter section 174 extending upwardly from adjacent the nose portion 170 to the proximal end 160, and a reduced diameter section 176 extending generally from the increased diameter section 174 to the distal end 162, with an annular shoulder 178 extending generally radially between the respective sections 174, 176.

The center electrode 118 may have any suitable shape, and is represented here, by way of example and without limitation, as having a body with a generally cylindrical outer surface 180 extending generally between an upper terminal end 182 and a lower firing end 184, and having a radially outward arcuate flair or taper to an increased diameter head 186 at the terminal end 182. The annular head 186 facilitates seating and sealing the terminal end 182 within insulator 114 against the shoulder 178. The firing end 184 of the center electrode 116 generally extends out of nose portion 170 of the insulator 114. The center electrode 116 is constructed from any suitable conductor material, as is well-known in the field of sparkplug manufacture, such as various Ni and Ni-based alloys, for example, and may also include such materials clad over a Cu or Cu-based alloy core.

The electrically conductive terminal stud 116 is partially disposed in the central channel 172 of the insulator 114 and extends longitudinally from an exposed top post 186 to a bottom end 188 embedded partway down the central channel 172. The top post 186 is configured for connection to an ignition wire (not shown) which is typically received in an electrically isolating boot (not shown) and receives timed discharges of high voltage electricity required to fire the spark plug 110 by generating a spark across the spark gap 125.

The bottom end 188 of the terminal stud 116 is embedded within a conductive glass seal 190. The conductive glass seal 190 functions to seal the bottom end 188 of terminal stud 116 and the central channel 172 from combustion gas leakage and to establish an electrical connection between the terminal stud 116 and the center electrode 118. Many other configurations of glass and other seals are well-known and may also be used in accordance with the invention. In addition, a resistor layer 192, as is known, made from any suitable composition known to reduce electromagnetic interference ("EMI"), can be disposed between the bottom end 188 of the terminal stud 116 and the terminal end 182 of the center electrode 118, with an additional glass seal 194 abutting and sealing the terminal end 182 of the center electrode 118.

The brazed joint 126 is illustrated in FIG. 2 as being between the outer surface 158 of the insulator 114 and the inner surface 144 of the metal shell 112 and bonding the insulator 114 to the shell 112. The brazed joint 126 extends generally from the lower shoulder 166 of the insulator 114 axially away from the nose portion 170, and is represented as extending substantially to the upper shoulder 164 of the insulator 114. The brazed joint 126 preferably extends substantially about the entire circumference of the insulator 114, thereby removing any voids (air/gas pockets) between the outer surface 158 of the insulator 114 and the inner surface 144 of the shell 112. This, in turn, reduces the number of potential locations where plasma might otherwise form, wherein plasma is believed to be a potential source of premature insulator fatigue. The brazed joint 126 can be formed using any suitable brazing material, such as various copper alloy and silver alloy brazes, for example, and can be performed prior to assembling the terminal stud 116 and center electrode 118 into the insulator 114, or after, as desired. The brazed joint 126 is preferably the sole mechanism for attaching and retaining the insulator 114 within the shell 112, and thus, no axially compressive forces, as typically involved in constructing conventional spark plugs, are imparted on the insulator 114. Accordingly, the insulator 114 is generally free from axially compressive forces that tend to propagate cracks therein.

Figure 3:
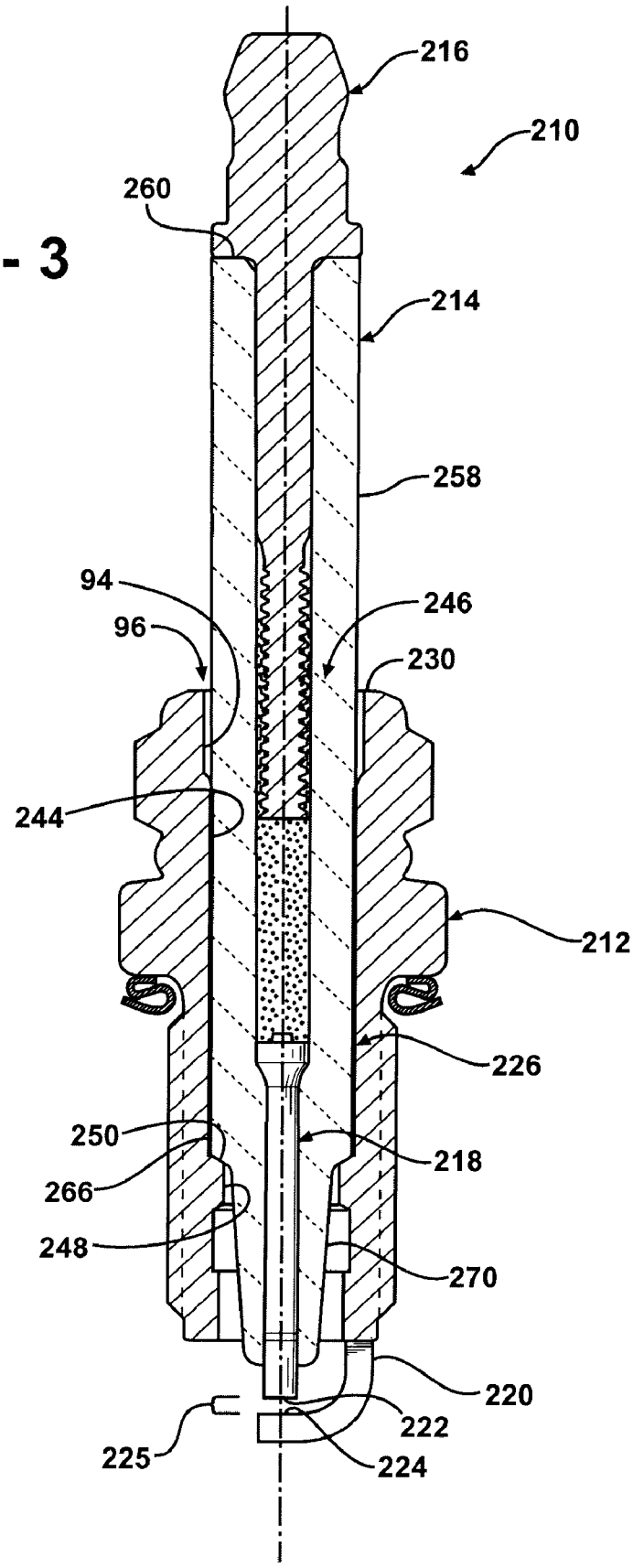
FIG. 3 is a cross-sectional view of a spark plug constructed in accordance with another presently preferred aspect of the invention.

In FIG. 3, another spark plug 210 constructed in accordance with the invention is illustrated, wherein the same reference numerals used above, offset by a factor of 200, are used to identify similar features as discussed above. The spark plug 210 has a shell 212, an insulator 214, a terminal stud 216, a center electrode 218, a ground electrode 220, with an associated spark gap 225 formed between respective firing surfaces 222, 224 of the center and ground electrodes 218, 220. In addition, a brazed joint 226 bonds an outer surface 258 of the insulator 214 to an inner surface 244 of the shell 212. The notable difference between the spark plug 210 and the previously discussed spark plug 110 is in the shape of the inner surface 244 of the shell 212 and the shape of the outer surface 258 of the insulator 214.

The inner surface 244 of the shell 212 has a lower flange 248 presenting a stop surface 250, however, it does not have an upper flange as with the shell 112. In contrast, the inner surface 244 of the shell 212 has a substantially straight, cylindrical surface extending from the stop surface 250 to an upper terminal end 230 of the shell 212. A slightly enlarged diameter portion 94 can be formed immediately adjacent the upper terminal end 230 to provide a circumferentially extending pocket 96 that acts to control and limit the flow of brazing material forming the brazed joint 226.

The outer surface 258 of the insulator 214 has a lower shoulder 266 configured to confront the lower flange 248 of the shell 212, however, it does not have an upper shoulder as with the insulator 114. In contrast, the outer surface 258 of the insulator 214 has a substantially straight, cylindrical surface of a constant diameter extending from the lower shoulder 216 to an upper proximal end 260 of the insulator 214. As such, the outer surface 258 has a substantially constant outer diameter, with the exception of a reduced diameter nose portion 270. Accordingly, the insulator 214 can be readily constructed using an extruding process, wherein the nose portion 270 can be machined or otherwise formed in a secondary operation, if desired.

The braze joint 226 of the spark plug 210 extends from the lower shoulder 266 of the insulator 214 to adjacent the terminal end 230 of the shell 112. The braze material, as mentioned, can flow into the pocket 96 in construction, wherein the pocket 96 acts to prevent the braze material from overflowing from between the insulator 214 and a cavity 246 of the shell 212. It should be recognized that the braze joint 226 could be formed to extend substantially flush with the upper terminal end 230 of the shell 212, if desired.

Figure 4:
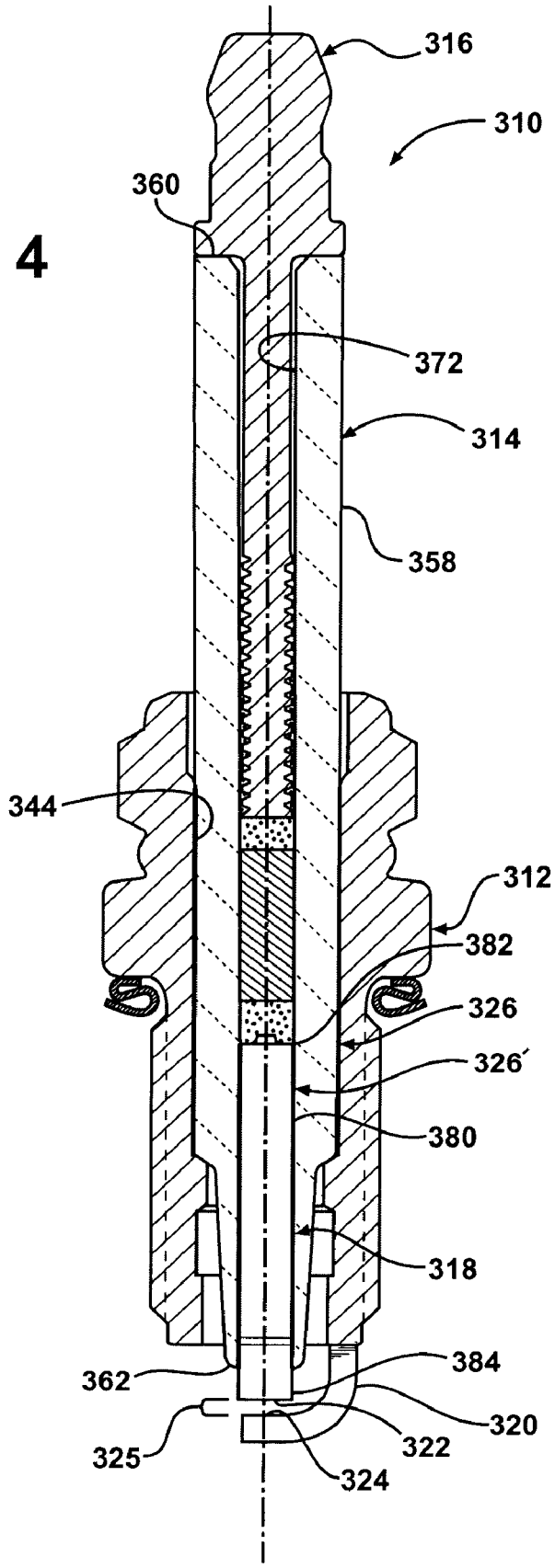
FIG. 4 is a cross-sectional view of a spark plug constructed in accordance with another presently preferred aspect of the invention.

In FIG. 4, another spark plug 310 constructed in accordance with the invention is illustrated, wherein the same reference numerals used above, offset by a factor of 300, are used to identify similar features as discussed above. The spark plug 310 has a shell 312, an insulator 314 with a channel 372, a terminal stud 316, a center electrode 318 with an outer surface 380, a ground electrode 320, with an associated spark gap 325 formed between respective firing surfaces 322, 324 of the center and ground electrodes 318, 320. In addition, a brazed joint 326 bonds an outer surface 358 of the insulator 314 to an inner surface 344 of the shell 312. The notable difference between the spark plug 310 and the previously discussed spark plug 212 is in the shape of the channel 372 of the insulator 314 and the shape of the outer surface 380 of the center electrode 318.

The channel 372 of the insulator 314, rather than having a lower shoulder, has a straight, cylindrical surface extending between opposite proximal and distal ends 360, 362. Accordingly, the insulator 314 is particularly well suited for fabrication in an extruding process.

The outer surface 380 of the center electrode 318, rather than having a flared, arcuate shape resulting terminating in an enlarged head, has a constant diameter extending over its entire length from a terminal end 382 to a firing end 384. Accordingly, the center electrode 218 is particularly well suited for fabrication in an extruding process.

In addition, the spark plug 310 has a second brazed joint 326' bonding the center electrode 318 to the insulator 314. The brazed joint 326' extends about the circumference of the outer surface 380 of the center electrode 38 to form a gas seal secure bond with the channel 372 of the insulator 314. In constructing the spark plug 310, the brazing process performed to form the brazed joints to bond the insulator 314 to the shell 312 and to bond the center electrode 318 to the insulator 314 can be performed separately, or in a single, concurrent brazing process, as desired.

Figure 5:
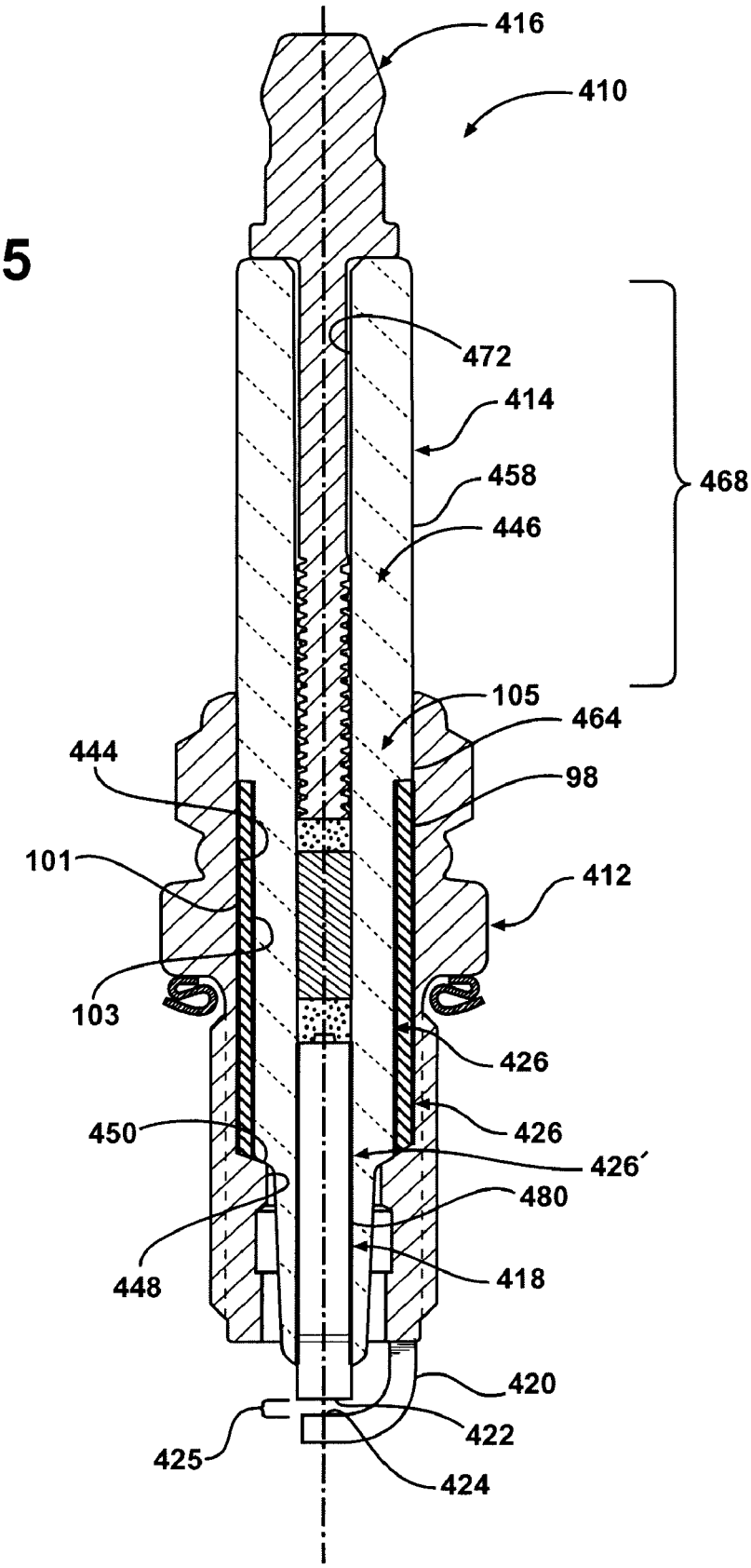
FIG. 5 is a cross-sectional view of a spark plug constructed in accordance with another presently preferred aspect of the invention.

In FIG. 5, another spark plug 410 constructed in accordance with the invention is illustrated, wherein the same reference numerals used above, offset by a factor of 400, are used to identify similar features as discussed above. The spark plug 410 has a shell 412 with an inner surface 444 providing a cavity 446 with a lower flange 448 presenting a stop surface 450, an insulator 414 with an outer surface 458 having an upper radially outwardly extending upper shoulder 464 and a central channel 472, a terminal stud 416, a center electrode 418 with an outer surface 480, a ground electrode 420, with an associated spark gap 425 formed between respective firing surfaces 422, 424 of the center and ground electrodes 418, 420. A brazed joint 426 bonds an outer surface 458 of the insulator 414 to the inner surface 444 of the shell 412.

The notable difference between the spark plug 310 and the previously discussed spark plugs 110, 210, 310 is in the incorporation of a metal tube 98 between the outer surface 458 of the insulator 414 and the inner surface 444 of the shell 412. The metal tube 98 is represented as extending the entire length between the stop surface 450 of the shell 412 and the upper shoulder 464 of the insulator 414, by way of example and without limitation. The metal tube 98 has an cylindrical outer surface 101 and an inner surface 103 providing a cavity 105. The cavity 105 is sized to receive the insulator 414 at least partially therein. The outer surface 101 is represented as having a diameter substantially the same as the diameter of an upper mast portion 468, and thus, the outer surface 101 of the tube 98 and the mast portion 468 form a substantially straight, cylindrical surface for receipt in the substantially straight, cylindrical cavity 446 of the shell 412. The brazed joint 426 is provided between the outer surface 101 of the tube 98 and the inner surface 444 of the shell 412 and/or between the inner surface 103 of the tube 98 and the outer surface 458 of the insulator 414. The brazed joint 426 is represented here extending along the entire length of both the outer and inner surfaces 101, 103 of the tube 98, and as discussed above, preferably extends about the entire inner and outer circumference of the respective surfaces. The spark plug 410 is also represented as having a brazed joint 426' bonding the center electrode 418 in the channel 472 of the insulator 414. The respective brazed joints 426, 426' can be performed separately in separate processes, or in a single, concurrent brazing process, as desired.

Figure 6:
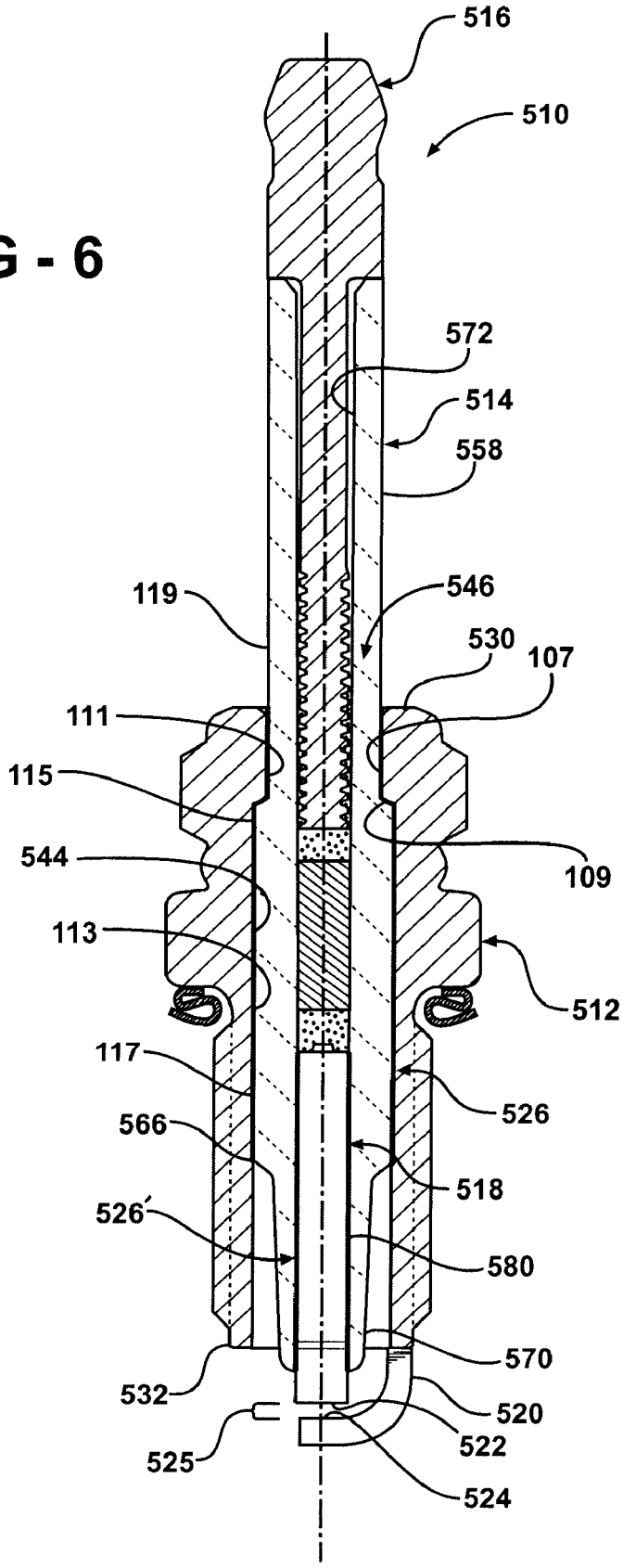
FIG. 6 is a cross-sectional view of a spark plug constructed in accordance with another presently preferred aspect of the invention.

In FIG. 6, another spark plug 510 constructed in accordance with the invention is illustrated, wherein the same reference numerals used above, offset by a factor of 500, are used to identify similar features as discussed above. The spark plug 510 has a shell 512 with an inner surface 544 providing a cavity 546, an insulator 514 with an outer surface 558 and a straight, cylindrical central channel 572, a terminal stud 516, a center electrode 518 with straight, cylindrical outer surface 580, a ground electrode 520, with an associated spark gap 525 formed between respective firing surfaces 522, 524 of the center and ground electrodes 518, 520. A brazed joint 526 bonds the outer surface 558 of the insulator 514 to the inner surface 544 of the shell 512.

The notable difference between the spark plug 510 and the previously discussed spark plugs 110, 210, 310, 410 is the configuration of the channel 546 of the shell 512 and the configuration of the outer surface 558 of the insulator 514. Rather than the shell 512 having a lower flange presenting a stop surface, the shell 512 has an upper flange 107 extending radially inwardly from the inner surface 544 adjacent a terminal end 530 of the shell 512. The upper flange 107 provides an upper stop surface 109, with a reduce diameter portion 111 extending upwardly from the stop surface 109, and an enlarged diameter portion 113 having a diameter greater than the reduced portion 111 and having a straight, cylindrical surface depending from the stop surface 109. Further, the insulator 514, in addition to having a lower shoulder 566, has a radially inwardly extending upper shoulder 115 configured to confront the upper stop surface 109 of the shell 512. Accordingly, the outer surface 558 of the insulator 514 has an enlarged diameter portion 117 extending between the lower and upper shoulders 566, 115, with a reduced diameter nose portion 570 depending from the lower shoulder 566 and a reduced diameter straight, cylindrical portion 119 extending upwardly from the upper shoulder 115.

As such, with the configurations of the cavity 546 of the shell 512 and the outer surface 558 of the insulator 514 described above and illustrated in FIG. 6, the insulator 514, rather than being inserted into the terminal end 530 of the shell 512, is inserted into a fastening end 532 of the shell 512 into the cavity 546, preferably until the upper shoulder 115 of the insulator 514 confronts the upper stop surface 109 of the upper flange 107. As in some of the above embodiments, the outer surface 580 of the center electrode 518 can be bonded via a brazed joint 526' to the channel 572 of the insulator 514. Further, to maintain the insulator 514 within the shell 512 the brazed joint 526 bonds the enlarged diameter portion 117 of the insulator outer surface 558 to the inner surface 544 of the shell 512. In use, with the upper shoulder 115 abutting the stop surface 109, any shear forces tending to be generated between the shell 512 and the insulator 514 from combustion with the combustion chamber can be taken through the abutting upper shoulder 115 and the upper stop surface 109, thereby reducing or eliminating the shear stresses placed on the brazed joint 526. Accordingly, the potential for failure of the bond between the shell 512 and the insulator 514 via the brazed joint 526 is greatly reduced, and thus, the useful life of the spark plug 510 can be optimized.

Figure 7:
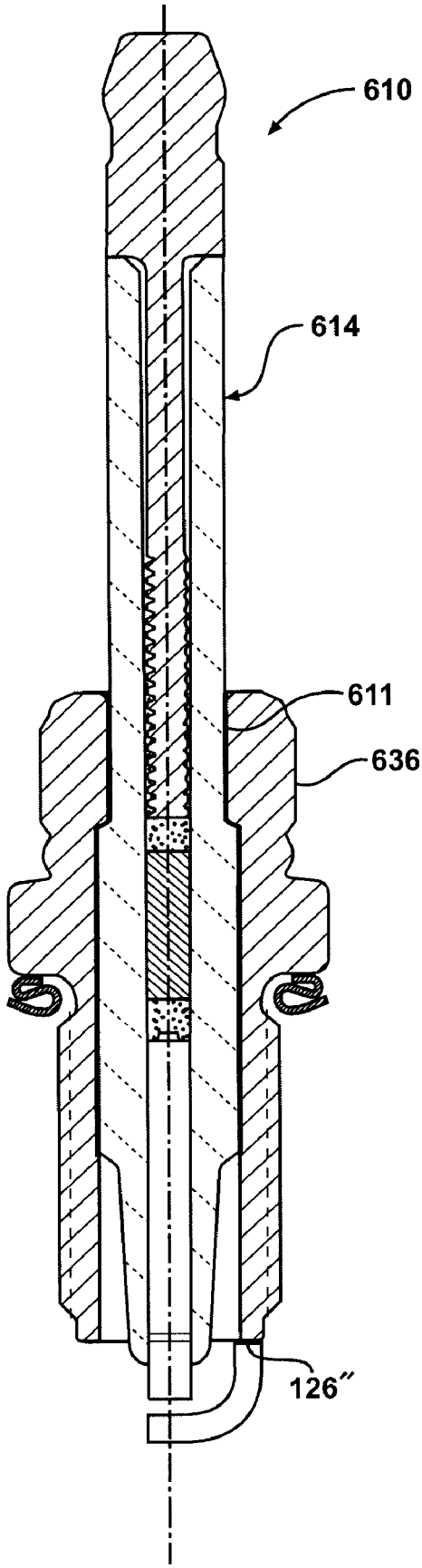
FIG. 7 is a cross-sectional view of a spark plug constructed in accordance with yet another presently preferred aspect of the invention.

In FIG. 7, another spark plug 610 constructed in accordance with the invention is illustrated, wherein the same reference numerals used above, offset by a factor of 600, are used to identify similar features as discussed above. The spark plug 610 is similar to the spark plug 510 above, however, given an insulator 614 has a reduced diameter portion 611 radially inwardly from a tool receiving member 636, the size of the tool receiving member 636 can be reduced in size from conventional spark plugs having insulators with relatively enlarged shoulders in this region of the insulator. Accordingly, overall weight, space and material savings can be achieved. Additionally, an additional brazed joint 126" attaches the a ground electrode 620 to a metal shell 612 of the spark plug 610.

Obviously, many modifications and variations of the present invention are possible in light of the above teachings. It is, therefore, to be understood that within the scope of the appended claims, the invention may be practiced otherwise than as specifically described.

What is claimed is:

1. A spark plug, comprising:

a generally annular ceramic insulator having an annular outer surface extending between a proximal end and a distal end with an annular lower shoulder extending radially inwardly from said outer surface between said ends and a reduced diameter nose portion extending from said lower shoulder to said distal end;

a metal shell having an inner surface providing a cavity surrounding at least a portion of said ceramic insulator;

a center electrode having an elongate body with a center electrode sparking surface; and a brazed joint extending from said lower shoulder of said insulator in direct contact with said inner surface of said shell axially away from said nose portion and fixing said shell to said insulator.

2. The spark plug of claim 1 wherein said shell has a lower flange configured to confront said lower shoulder of said insulator.

3. The spark plug of claim 2 wherein said outer surface of said insulator extends substantially straight and cylindrically from said lower shoulder away from said nose portion to said proximal end.

4. The spark plug of claim 3 wherein said shell extends axially between a terminal end and a fastening end configured for attachment to an engine block, said cavity having a substantially straight, cylindrical surface extending axially away from said lower flange toward said terminal end.

5. The spark plug of claim 2 wherein said outer surface of said insulator immediately adjacent said lower shoulder provides a maximum outer diameter of said insulator.

6. The spark plug of claim 2 wherein said insulator has an annular upper shoulder between said lower shoulder and said proximal end, said brazed joint extending between said lower shoulder and said upper shoulder.

7. The spark plug of claim 6 wherein said upper shoulder extends radially outwardly in relation to said lower shoulder.

8. The spark plug of claim 1 wherein said insulator has an annular upper shoulder between said lower shoulder and said proximal end, said outer surface of said insulator having a maximum diameter between said lower shoulder and said upper shoulder.

9. The spark plug of claim 8 wherein said shell has a radially inwardly extending upper flange configured to confront said upper shoulder of said insulator.

10. The spark plug of claim 8 wherein said brazed joint extends between said lower shoulder and said upper shoulder of said insulator.

11. The spark plug of claim 9 wherein said shell extends axially between a terminal end and a fastening end configured for attachment to an engine block, said cavity having a substantially straight cylindrical surface extending axially away from said upper flange toward said fastening end.

12. The spark plug of claim 1 wherein said center electrode has an annular outer surface and said insulator has a through channel, and further comprising a brazed joint extending between said outer surface of said center electrode and said through channel to bond said center electrode to said insulator.

13. A spark plug, comprising:

a generally annular ceramic insulator;

a metal shell surrounding at least a portion of said ceramic insulator;

a center electrode having an elongate body with an annular outer surface extending between an upper terminal end and a lower firing end, said outer surface of said center electrode has a substantially constant outer diameter; and a brazed joint bonding said center electrode directly to said insulator.

14. The spark plug of claim 1 further comprising a metal tube having an inner surface bounding a cavity and an outer surface, said insulator being disposed at least partially in said cavity and said metal tube being disposed at least partially in said shell, said brazed joint bonding said outer surface of said metal tube to said shell along the entire length of said metal tube outer surface.

15. The spark plug of claim 14 wherein said center electrode has an annular outer surface and said insulator has a through channel, a brazed joint extending between said outer surface of said center electrode and said through channel to bond said center electrode to said insulator.

16. The spark plug of claim 15 wherein said outer surface of said center electrode has a substantially constant outer diameter.

17. The spark plug of claim 1 further comprising a ground electrode and a brazed joint connecting said ground electrode to said metal shell.

18. A method of constructing a spark plug, wherein the spark plug has a generally annular ceramic insulator having an annular outer surface extending between a proximal end and a distal end with an annular lower shoulder extending radially inwardly from the outer surface between the proximal and distal ends and a reduced diameter nose portion extending from the lower shoulder to the distal end with a through passage extending between the proximal and distal ends; an outer metal shell having a cavity with an inner surface surrounding at least a portion of the ceramic insulator and having a ground electrode operatively attached thereto, and a center electrode extending into the through passage of the ceramic insulator, comprising:

brazing a joint extending from the lower shoulder of the insulator in direct contact with the inner surface of the shell axially away from the nose portion and bonding the insulator to the shell.

19. The method of claim 18 further including providing the shell with a lower flange configured to confront the lower shoulder of the insulator, and further including forming the outer surface of the insulator to extend substantially straight and cylindrically from the lower shoulder away from the nose portion.

20. The method of claim 19 wherein the shell has a terminal end and a fastening end configured for attachment to an engine block, and further including forming the inner surface of the shell cavity having a substantially straight, cylindrical surface extending axially away from the lower flange toward the terminal end.

21. The method of claim 18 wherein the insulator has an annular upper shoulder between the lower shoulder and the proximal end, and further including brazing the joint between the outer surface of the ceramic insulator and the inner surface of the shell to extend in direct contact with the inner surface of the shell from the lower shoulder to the upper shoulder.

22. The method of claim 21 wherein the shell has a radially inwardly extending upper flange configured to confront the upper shoulder of the insulator and the shell extends axially between a terminal end and a fastening end configured for attachment to an engine block, and further including forming the inner surface of the shell cavity having a substantially straight, cylindrical surface extending axially away from the upper flange toward the fastening end.

23. The method of claim 18 further including disposing a metal tube concentrically between the outer surface of the insulator and the inner surface of the shell and brazing the joint to bond at least one of an outer surface the tube to the inner surface of the shell or, an inner surface of the tube to the outer surface of the insulator.

24. The method of claim 18 further including extruding the ceramic insulator.

25. The method of claim 18 further including extruding the center electrode.

26. The method of claim 18 further including brazing a joint bonding the ground electrode to the metal shell.

* * * * *